US008087463B2

(12) United States Patent
Wright et al.

(10) Patent No.: US 8,087,463 B2
(45) Date of Patent: Jan. 3, 2012

(54) MULTI-POSITION HYDRAULIC ACTUATOR

(75) Inventors: Adam D. Wright, Al Khobar (SA); Adam H. Martin, Addison, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 255 days.

(21) Appl. No.: 12/352,901

(22) Filed: Jan. 13, 2009

(65) Prior Publication Data

US 2010/0175871 A1 Jul. 15, 2010

(51) Int. Cl.
*E21B 34/14* (2006.01)

(52) U.S. Cl. ..... 166/319; 166/321; 166/244.1

(58) Field of Classification Search ..... 166/72, 166/244.1, 319, 321
See application file for complete search history.

(56) References Cited

U.S. PATENT DOCUMENTS

| | | | |
|---|---|---|---|
| 3,092,135 | A | 6/1963 | Brown, Jr. et al. |
| 3,494,419 | A | 2/1970 | Mullins |
| 3,533,430 | A | 10/1970 | Fredd |
| 3,762,471 | A | 10/1973 | Mott |
| 3,834,460 | A | 9/1974 | Brun et al. |
| 4,025,883 | A | 5/1977 | Slade et al. |
| 4,230,187 | A | 10/1980 | Seto et al. |
| 4,347,900 | A | 9/1982 | Barrington |
| 4,398,519 | A | 8/1983 | Tissot et al. |
| 4,421,174 | A | 12/1983 | McStravick et al. |
| 4,566,478 | A | 1/1986 | Deaton |
| 4,633,952 | A | 1/1987 | Ringgenberg |
| 4,658,904 | A | 4/1987 | Doremus et al. |
| 4,848,472 | A | 7/1989 | Hopper |
| 4,922,423 | A | 5/1990 | Koomey et al. |
| 4,979,568 | A | 12/1990 | Spencer, III et al. |
| 4,986,357 | A | 1/1991 | Pringle |
| 5,050,681 | A | 9/1991 | Skinner |
| 5,101,907 | A | 4/1992 | Schultz et al. |
| 5,127,477 | A | 7/1992 | Schultz |
| 5,192,167 | A | 3/1993 | Da Silva et al. |
| 5,234,057 | A | 8/1993 | Schultz et al. |

(Continued)

FOREIGN PATENT DOCUMENTS

EP 0500341 B1 8/1992

(Continued)

OTHER PUBLICATIONS

Schlumberger IRIS Safety Valve Product Brochure, 2007, 1 page.

(Continued)

*Primary Examiner* — David Bagnell
*Assistant Examiner* — Richard Alker
(74) *Attorney, Agent, or Firm* — Marlin R. Smith

(57) ABSTRACT

A method of actuating a well tool utilizing first and second pressure sources includes the steps of: placing an actuator chamber in communication with the first pressure source, thereby displacing a piston from a first position to a second position; and then placing another chamber in communication with the second pressure source, thereby displacing the piston to a third position. A multi-position actuator includes an operating member which displaces to operate a well tool, a first position of the operating member corresponding to a pressure source being in communication with a chamber and another pressure source being in communication with another chamber, a second position of the operating member corresponding to the same pressure source being in communication with both of the chambers, and a third position of the operating member corresponding to the pressure sources being connected to the chambers oppositely to that of the first position.

17 Claims, 6 Drawing Sheets

U.S. PATENT DOCUMENTS

| | | | | |
|---|---|---|---|---|
| 5,238,070 | A | 8/1993 | Schultz et al. | |
| 5,251,703 | A | 10/1993 | Skinner | |
| 5,271,313 | A | 12/1993 | Lindegren, III | |
| 5,273,113 | A | 12/1993 | Schultz | |
| 5,412,568 | A | 5/1995 | Schultz | |
| 5,831,156 | A | 11/1998 | Mullins | |
| 5,890,542 | A | 4/1999 | Ringgenberg | |
| 6,085,845 | A | 7/2000 | Patel et al. | |
| 6,419,022 | B1 | 7/2002 | Jernigan et al. | |
| 6,422,315 | B1 | 7/2002 | Dean | |
| 6,450,258 | B2 | 9/2002 | Green et al. | |
| 6,536,530 | B2 | 3/2003 | Schultz et al. | |
| 6,622,799 | B2 | 9/2003 | Dean | |
| 6,782,952 | B2 | 8/2004 | Garay et al. | |
| 6,799,633 | B2 | 10/2004 | McGregor | |
| 6,917,857 | B2 | 7/2005 | Rentmeester et al. | |
| 7,011,289 | B2 | 3/2006 | Singh | |
| 7,082,994 | B2 | 8/2006 | Frost, Jr. et al. | |
| 7,111,675 | B2 | 9/2006 | Zisk, Jr. | |
| 7,140,436 | B2 | 11/2006 | Grant et al. | |
| 7,201,230 | B2 | 4/2007 | Schultz et al. | |
| 7,240,734 | B2 | 7/2007 | Nivens et al. | |
| 7,448,591 | B2 | 11/2008 | Ross | |
| 2004/0226720 | A1 | 11/2004 | Schultz et al. | |
| 2007/0029078 | A1 * | 2/2007 | Wright et al. | 166/72 |
| 2009/0095463 | A1 | 4/2009 | Swan et al. | |
| 2009/0095486 | A1 | 4/2009 | Williamson, Jr. | |

FOREIGN PATENT DOCUMENTS

| | | | |
|---|---|---|---|
| EP | 0500343 | B1 | 8/1992 |
| EP | 0604156 | B1 | 6/1994 |
| WO | 2003021075 | A1 | 3/2003 |

OTHER PUBLICATIONS

Schlumberger IRIS Dual Valve Product Brochure, 2007, 2 pages.

Schlumberger IRIS Pulse-operated fullbore tools Product Brochure, Oct. 2001, 8 pages.

Halliburton DynaLink™ Telemetry System Product Brochure, Jan. 2009, 2 pages.

Examination Report for GB0609150.8 issued Jun. 5, 2007, 1 page.

Examination Report for GB 0410709.0 issued Aug. 31, 2006, 1 page.

Search Report for GB 0410709.0 issued Aug. 18, 2004, 1 page.

Office Action issued Jul. 8, 2005, for U.S. Appl. No. 10/438,793, 14 pages.

Office Action issued Jun. 22, 2006, for U.S. Appl. No. 10/438,793, 6 pages.

Scott Rotary Seals Custom Products webpage, Nov. 14, 2007, 2 pages.

Scott Rotary Seals Product Family Introduction webpage, Nov. 27, 2007, 1 page.

Halliburton Drawing D00091352, Apr. 15, 2003, 14 pages.

Office Action issued Dec. 16, 2010, for U.S. Appl. No. 12/352,892, 14 pages.

Office Action issued Mar. 2, 2011, for U.S. Appl. No. 12/410,785, 16 pages.

Office Action issued Jun. 30, 2001 for U.S. Appl. No. 13/021,624, 20 pages.

* cited by examiner

MULTI-POSITION HYDRAULIC ACTUATOR

BACKGROUND

The present disclosure relates generally to equipment utilized and operations performed in conjunction with a subterranean well and, in an embodiment described herein, more particularly provides a multi-position hydraulic actuator.

Many actuators for operating downhole well tools include a piston which is displaced back and forth between two positions in response to differential pressure applied to the piston in alternating directions. For example, a valve can be opened by displacing the piston in one direction, and the valve can be closed by displacing the piston in an opposite direction.

Unfortunately, using this type of actuator generally requires that each well tool be operated using an individual actuator, and that each actuator be supplied with pressure from pressure sources via multiple lines. This increases the complexity and expense, and reduces the reliability, of systems which require operation of multiple well tools. Furthermore, design limitations of available space (design envelope) are easily exceeded when using traditional methods of one hydraulic control line for each actuator position.

Even if only a single well tool is to be operated using such an actuator, an operator is typically limited to only two configurations of the well tool corresponding to the two positions of the piston in the actuator.

Therefore, it will be appreciated that advancements are needed in the art of providing multi-position actuators for operation of downhole well tools.

SUMMARY

In the present specification, actuators and associated methods are provided which solve at least one problem in the art. One example is described below in which at least three positions of an actuator are achieved by manipulating pressure in only two lines connected to the actuator. Another example is described below in which multiple well tools are actuated using a single actuator with multiple positions.

In one aspect, a method of actuating at least one well tool utilizing relatively high and low pressure sources is provided by this disclosure. The method includes the steps of: placing a chamber of an actuator for the well tool in communication with the high pressure source, thereby displacing a piston from a first position to a second position; and then placing another chamber of the actuator in communication with the low pressure source, thereby displacing the piston from the second position to a third position.

In another aspect, the disclosure provides a multi-position actuator for actuating at least one well tool utilizing relatively high and low pressure sources. The actuator includes multiple chambers in the actuator, and an operating member which displaces to operate the well tool. A first position of the operating member corresponds to the low pressure source being in communication with the first chamber and the high pressure source being in communication with the second chamber, a second position of the operating member corresponds to the high pressure source being in communication with both of the chambers, and a third position of the operating member corresponds to the high pressure source being in communication with the first chamber and the low pressure source being in communication with the second chamber.

In yet another aspect, a multi-position actuator for actuating at least one well tool utilizing relatively high and low pressure sources is provided by the disclosure. The actuator includes multiple chambers in the actuator, and a piston which displaces an operating member to operate the well tool. The piston has a first position in the actuator corresponding to the low pressure source being in communication with the first chamber and the high pressure source being in communication with the second chamber. The piston has a second position in the actuator corresponding to the high pressure source being in communication with both of the chambers. The piston has a third position in the actuator corresponding to the high pressure source being in communication with the first chamber and the low pressure source being in communication with the second chamber.

These and other features, advantages and benefits will become apparent to one of ordinary skill in the art upon careful consideration of the detailed description of representative embodiments below and the accompanying drawings, in which similar elements are indicated in the various figures using the same reference numbers.

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which are not limited to any specific details of these embodiments.

In the following description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
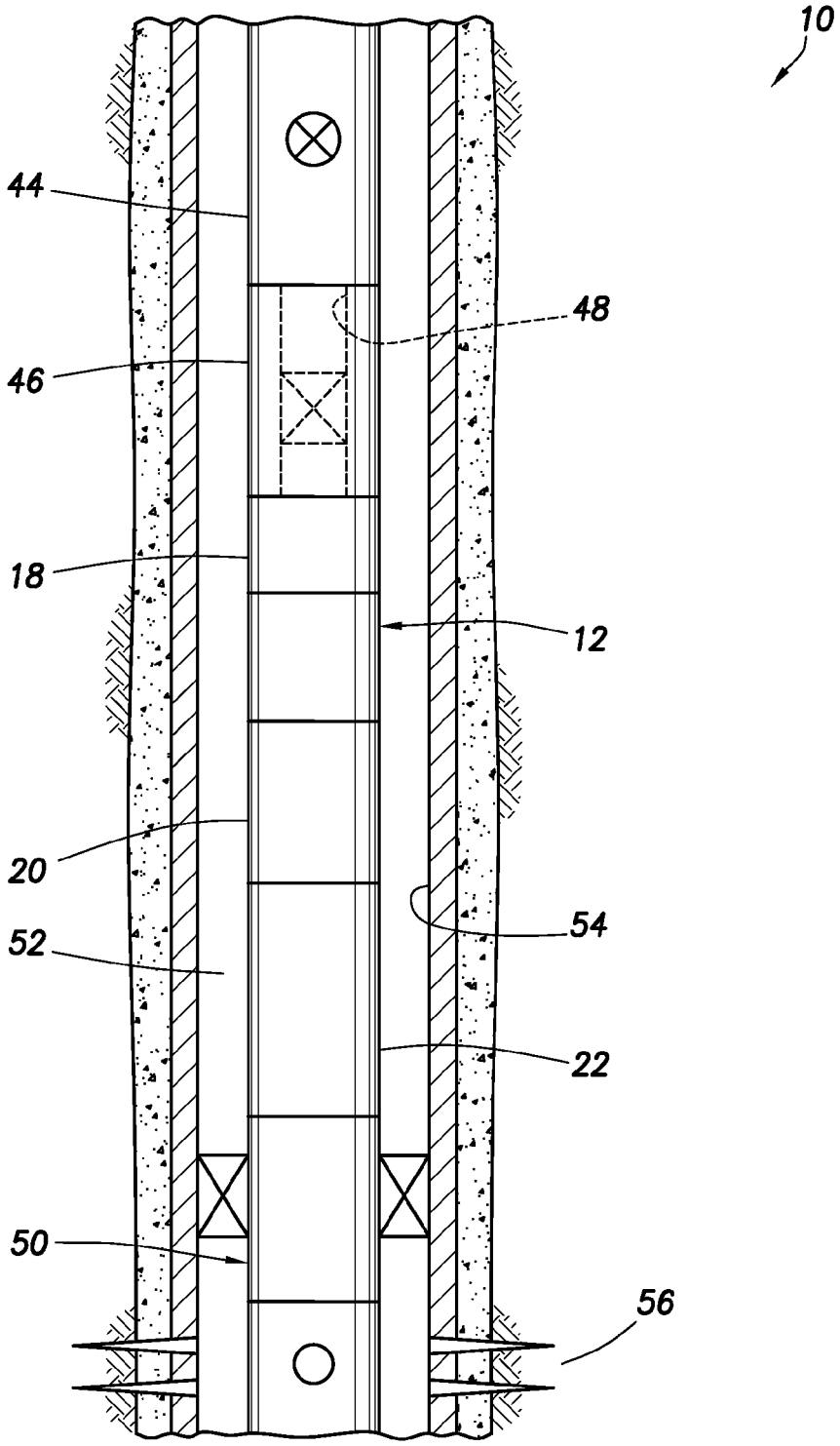
FIG. 1 is a schematic partially cross-sectional view of a well system embodying principles of the present disclosure.

Representatively illustrated in FIG. 1 is a well system 10 which embodies principles of the present disclosure. In the well system 10, a drill stem test is performed utilizing, in part, well tools 44, 46 for controlling flow between an interior flow passage 48 of a tubular string 50, an annulus 52 formed between the tubular string and a wellbore 54, and a formation 56 intersected by the wellbore. The wellbore 54 could be cased, as depicted in FIG. 1, or it could be uncased.

Figure 2:
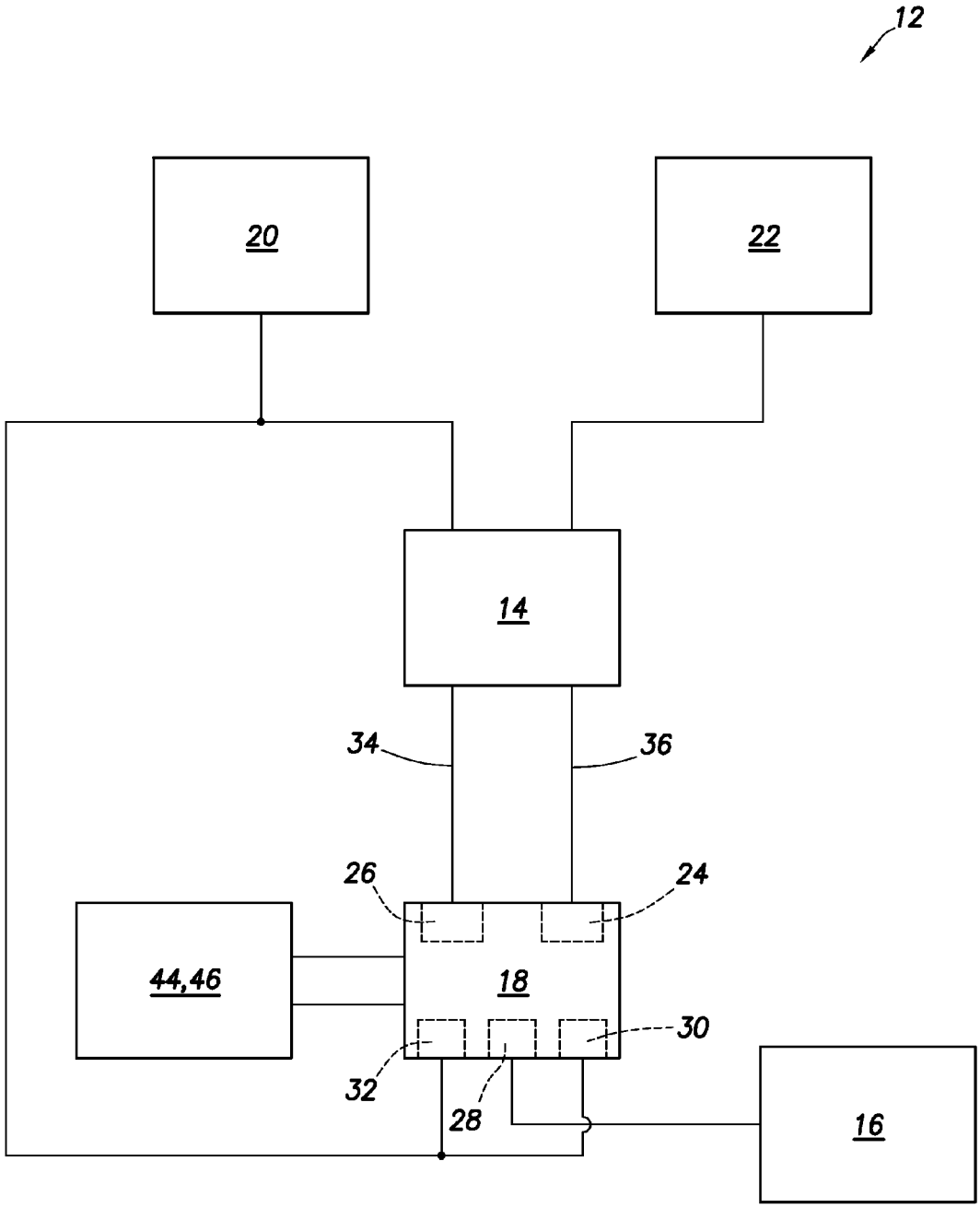
FIG. 2 is a schematic hydraulic circuit diagram for a control system which may be used in the well system of FIG. 1.

An actuator control system 12 is interconnected in the tubular string 50. The control system 12 is used to control operation of an actuator 18 for the well tools 44, 46 during the drill stem test. The control system 12 may be of conventional design and so is not described further herein, but a schematic control valve 14 which may be used to control operation of the well tools 44, 46 via the actuator 18 is depicted in FIG. 2.

Alternatively, a control system for controlling operation of the well tools 44, 46 could be as described in the U.S. patent application filed concurrently herewith, entitled MODULAR ELECTRO-HYDRAULIC CONTROLLER FOR WELL TOOL, attorney docket no. 2008-IP-016830 U1 US, the entire disclosure of which is incorporated herein by this reference.

The control system 12 controls operation of the actuators by selectively applying pressure to pistons of the actuator 18. For this purpose, the tubular string 50 may also include pressure sources 20, 22.

For example, a relatively low pressure source could be an atmospheric chamber or a low pressure side of a pump. A relatively high pressure source could be a pressurized gas chamber, hydrostatic pressure in the well, or a high pressure side of a pump. Any type of pressure source could be used, and it is not necessary for any of the pressure sources to be interconnected in the tubular string 50, in keeping with the principles of this disclosure. For example, if hydrostatic pressure is used as a pressure source, the annulus 52 or passage 48 could serve as the pressure source.

The well tool 44 is depicted in FIG. 1 as being a circulating valve, and the well tool 46 is depicted as being a tester valve. However, actuation of any other type or combination of well tools could be controlled using the control system 12.

At this point, it should be reiterated that the well system 10 is merely one example of an application of the principles of this disclosure. It is not necessary for a drill stem test to be performed, for the control system 12 to be interconnected in the tubular string 50, for fluid communication between the formation 56, passage 48 and annulus 52 to be controlled, or for well tools 44, 46 to be actuated. The principles of this disclosure are not limited in any manner to the details of the well system 10.

Referring additionally now to FIG. 2, a schematic hydraulic circuit diagram of the control system 12 is representatively illustrated apart from the well system 10. In this view, it may be seen that a control valve 14 of the control system 12 is interconnected between the pressure sources 20, 22 and respective first and second chambers 24, 26 in the actuator 18.

As depicted in FIG. 2, another pressure source 16 is shown as being in continuous communication with a third chamber 28, and the pressure source 20 is in continuous fluid communication with fourth and fifth chambers 30, 32 of the actuator. However, operation of the actuator 18 can be controlled by directing the pressures of the pressure sources 20, 22 to the first and second chambers 24, 26 via only two lines 34, 36 extending between the control valve 14 and the actuator 18.

The pressure source 16 is preferably merely a low pressure in the chamber 28. For example, the chamber 28 may be a sealed chamber at atmospheric pressure (or another relatively low pressure), without connecting a separate pressure source 16 to the chamber. Alternatively, the chamber 28 could be in communication with the low pressure source 22, in which case the pressure source 16 would correspond to the pressure source 22.

In the example of FIG. 2, the first pressure source 20 will be described as a high pressure source, and the second pressure source 22 will be described as a low pressure source. In other words, the first pressure source 20 supplies an increased pressure relative to the pressure supplied by the second pressure source 22.

For example, the first pressure source 20 could supply hydrostatic pressure and the second pressure source 22 could supply substantially atmospheric pressure. The preferable condition is that a pressure differential between the first and second pressure sources 20, 22 is maintained, at least during operation of the actuator 18. The chamber 28 is preferably at a lower pressure than that supplied by the first pressure source 20.

Figure 3A:
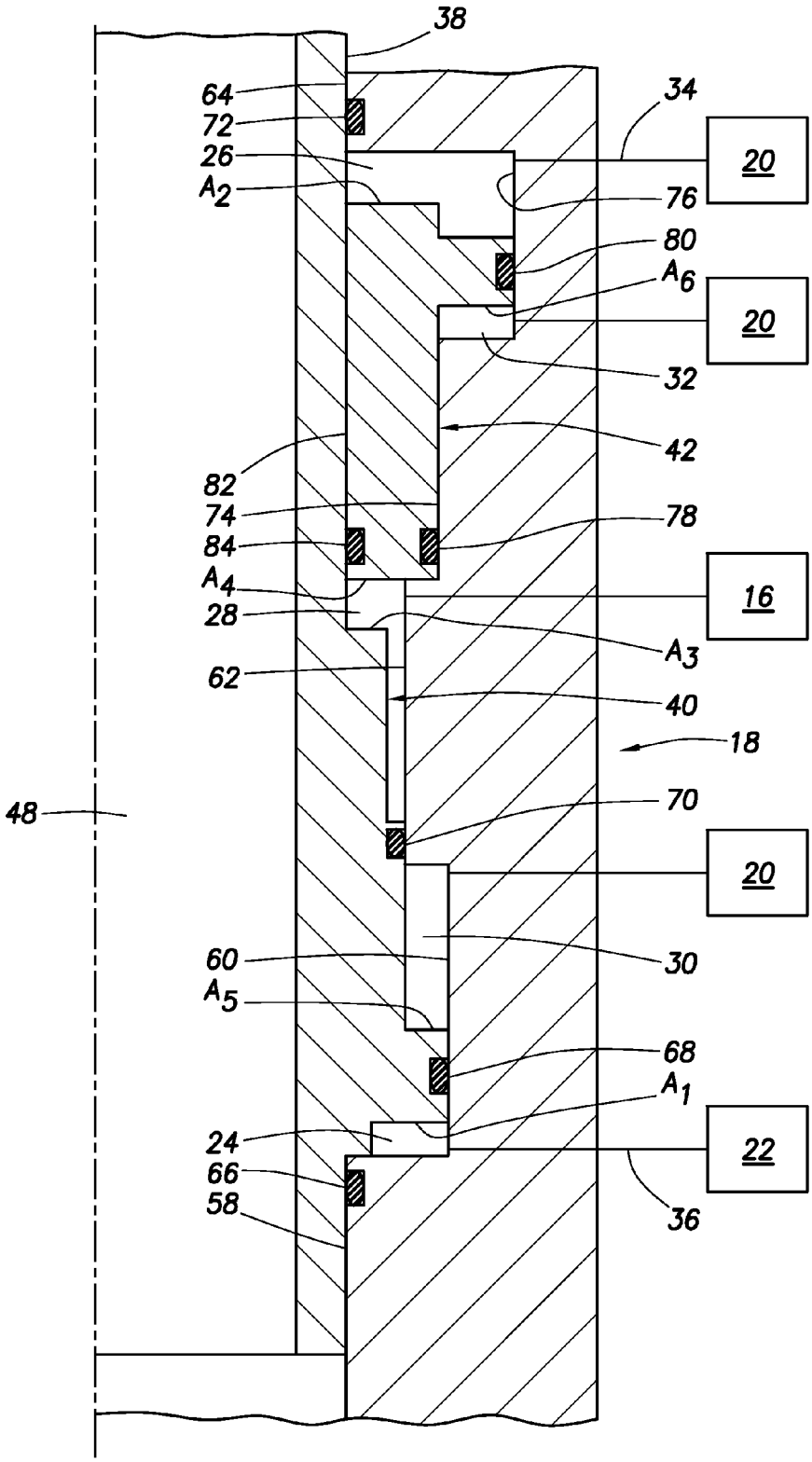
FIGS. 3A-C are schematic cross-sectional views of an actuator which may be used in the control system of FIG. 2, and in the well system of FIG. 1, the actuator embodying principles of the present disclosure.
Figure 3B:
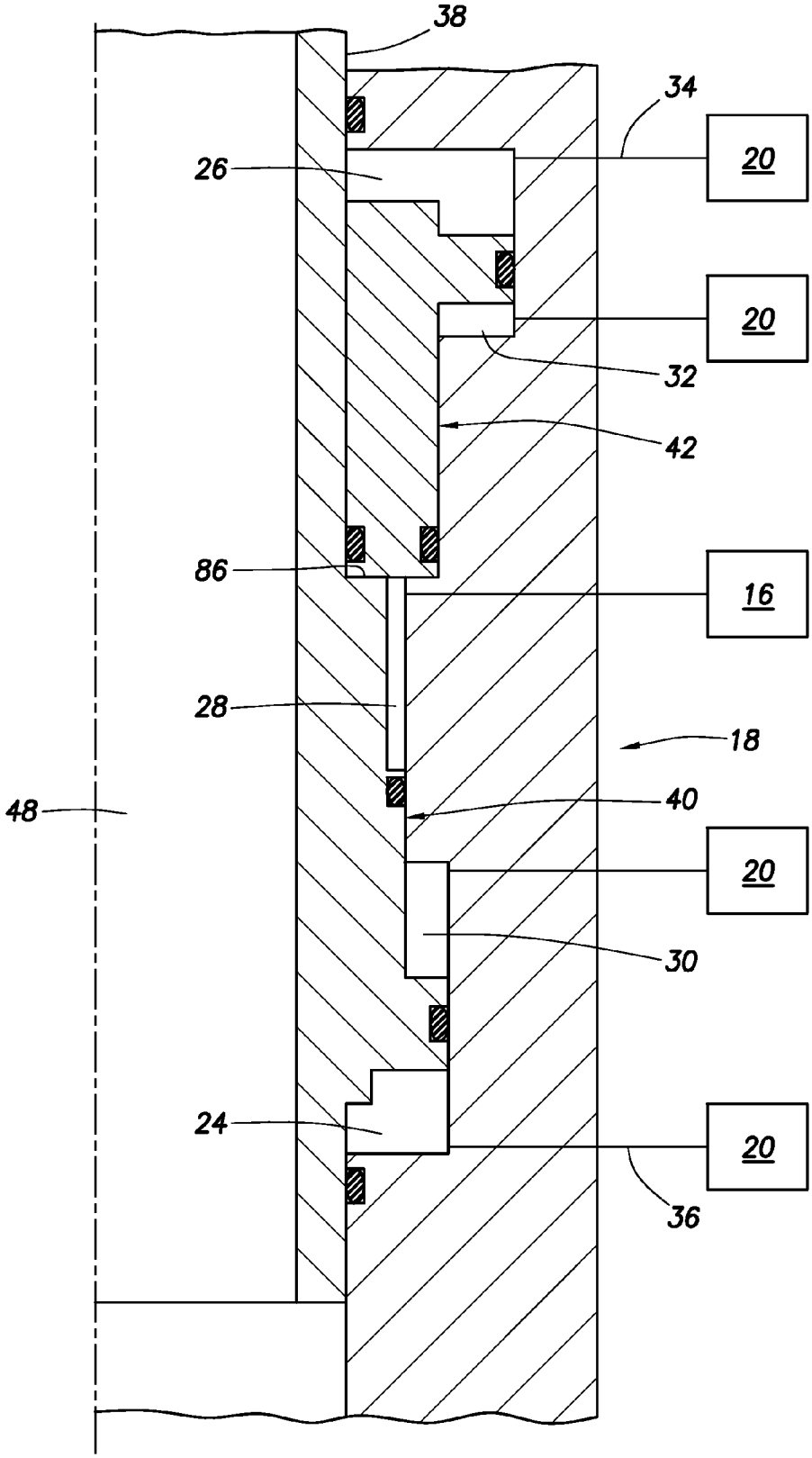
Figure 3C:
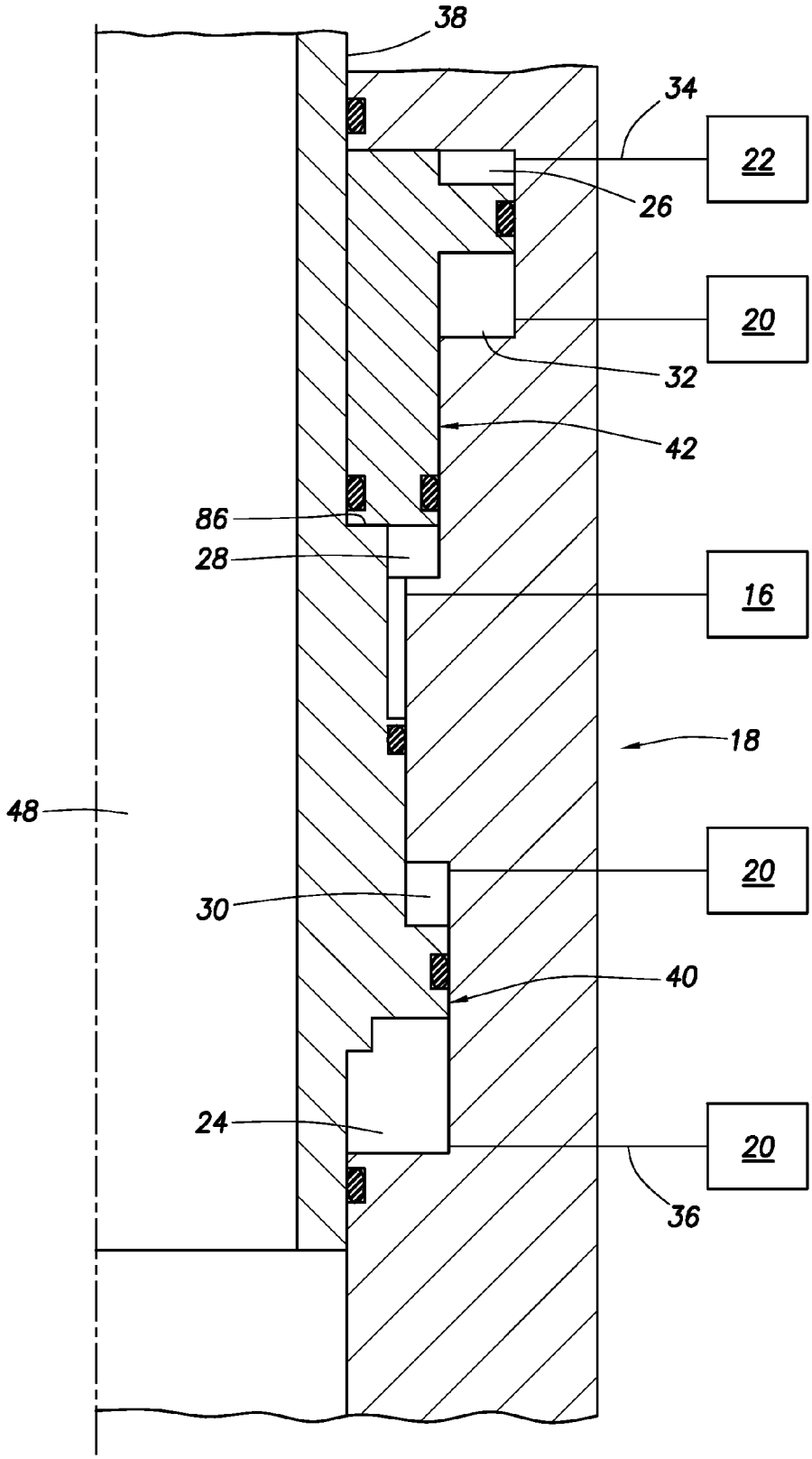

When it is desired to displace an operating member 38 and thereby actuate the well tools 44, 46, the control valve 14 places the first and second chambers 24, 26 in communication with appropriate ones of the pressure sources. For example (as depicted in FIG. 3A), a first position of the operating member 38 may correspond to the high pressure source 20 being in communication with the second chamber 26 and the low pressure source 22 being in communication with the first chamber 24. The operating member 38 can be displaced from the first position to a second position (as depicted in FIG. 3B) which corresponds to the high pressure source 20 being in communication with both of the first and second chambers 24, 26. The operating member 38 can be displaced from the second position to a third position (as depicted in FIG. 3C) which corresponds to the high pressure source 20 being in communication with the first chamber 24 and the low pressure source being in communication with the second chamber 26.

Preferably, the operating member 38 can be displaced from any of its three positions to any of its other two positions, and in any order, by merely operating the control valve 14 to place each of the pressure sources 20, 22 in communication with the respective one of the chambers 24, 26. For example, the operating member 38 can be displaced from the third position to the second position, from the second position to either of the first or third positions, and from the second position to the first position.

Thus, it will be appreciated that pressure in only the two lines 34, 36 can be manipulated to produce more than two positions of the operating member 38. This is a unique advantage of the actuator 18 over prior actuator designs, aiding multi-function actuator systems with minimal hardware.

In the example of FIG. 2, displacement of the operating member 38 between the first and second positions can be used to selectively open and close the well tool 46, and displacement of the operating member between the second and third positions can be used to selectively open and close the well tool 44. In the well system of FIG. 1, the well tools 44, 46 are valves which are operated to permit or prevent flow.

However, other types of well tools could be operated using the multiple positions of the operating member 38 produced by the actuator 18. For example, a choke could be operated to various flow choking positions by the actuator 18, a packer, hanger or plug could be set and released from a running tool, or a multi-position gravel packing tool could be operated, etc. Thus, it should be clearly understood that the principles of this disclosure are not limited in any manner to any particular type or number of well tool(s) described herein as being operated by the actuator 18.

Referring additionally now to FIGS. 3A-C, enlarged scale cross-sectional views of one example of the actuator 18 are representatively illustrated. FIG. 3A corresponds to the first position of the operating member 38, FIG. 3B corresponds to the second position of the operating member, and FIG. 3C corresponds to the third position of the operating member as described above.

In this example, the operating member 38 comprises an upper end of a first piston 40 reciprocably disposed in the actuator 18. A second piston 42 is also reciprocably disposed in the actuator 18. For clarity of illustration and description, the piston 40 and operating member 38 are depicted in FIG. 2 as being only a single structure, and the piston 42 is depicted in FIG. 2 as being only a single structure, but any or all of these could comprise multiple structures in keeping with the principles of this disclosure.

The first piston 40 is sealingly received in bores 58, 60, 62, 64 with respective seals 66, 68, 70, 72. The second piston 42 is sealingly received in bores 74, 76 with respective seals 78, 80. The first piston 40 is sealingly received in a bore 82 in the second piston 42 with a seal 84.

The bores 58, 60 define a first surface area A1 on the first piston 40 which is exposed to the first chamber 24, the bores 64, 76 define a second surface area A2 on the second piston 42 which is exposed to the second chamber 26, the bores 62, 82 define a third surface area A3 on the first piston which is exposed to the third chamber 28, the bores 74, 82 define a fourth surface area A4 on the second piston which is exposed to the third chamber 28, the bores 60, 62 define a fifth surface area A5 on the first piston which is exposed to the fourth chamber 30, and the bores 74, 76 define a sixth surface area A6 on the second piston which is exposed to the fifth chamber 32.

Preferably, the surface area A1 is equal to the sum of the surface areas A3 and A5, and the surface area A2 is equal to the sum of the surface areas A4 and A6. It is also preferred that the surface area A2 is greater than the surface area A1, and that the surface area A4 is greater than the surface area A3.

In the configuration of FIG. 3A, the high pressure source 20 is in communication with the second chamber 26, and the low pressure source 22 is in communication with the first chamber 24. This results in the first piston 40 being biased downwardly (since the chamber 30 is in communication with the high pressure source 20 and both of the chambers 24, 28 are at relatively low pressures), and the second piston 42 being biased downwardly (since the chambers 26, 32 are in communication with the high pressure source 20 and the chamber 28 is at a relatively low pressure). Note that the stroke of the piston 40 is limited by an upset due to seal bore 58. Thus, the operating member 38 and piston 40 are at the first position.

In the configuration of FIG. 3B, both of chambers 24, 26 are in communication with the high pressure source 20. This results in the first piston 40 being biased upwardly into contact with the second piston 42 (since the chambers 24, 30 are in communication with the high pressure source 20, and the chamber 28 is at a relatively low pressure). However, the second piston 42 prevents the first piston 40 from displacing further upward, due to abutting contact between the second piston 42 and a shoulder 86 on the first piston. The first piston 40 cannot displace the second piston 42 upwardly, since the surface area A4 on the second piston is greater than the surface area A3 on the first piston. Thus, the operating member 38 is displaced to the second position with the piston 40.

In the configuration of FIG. 3C, the first chamber 24 is in communication with the high pressure source 20 and the second chamber is in communication with the low pressure source 22. This results in the first piston 40 being biased upwardly (since the chambers 24, 30 are in communication with the high pressure source 20 and the chamber 28 is at a relatively low pressure), and the second piston 42 being biased upwardly (since the chamber 32 is in communication with the high pressure source 20 and the chambers 26, 28 are at relatively low pressures). Thus, the operating member 38 is displaced further upward with the piston 40 to the third position.

Figure 4:
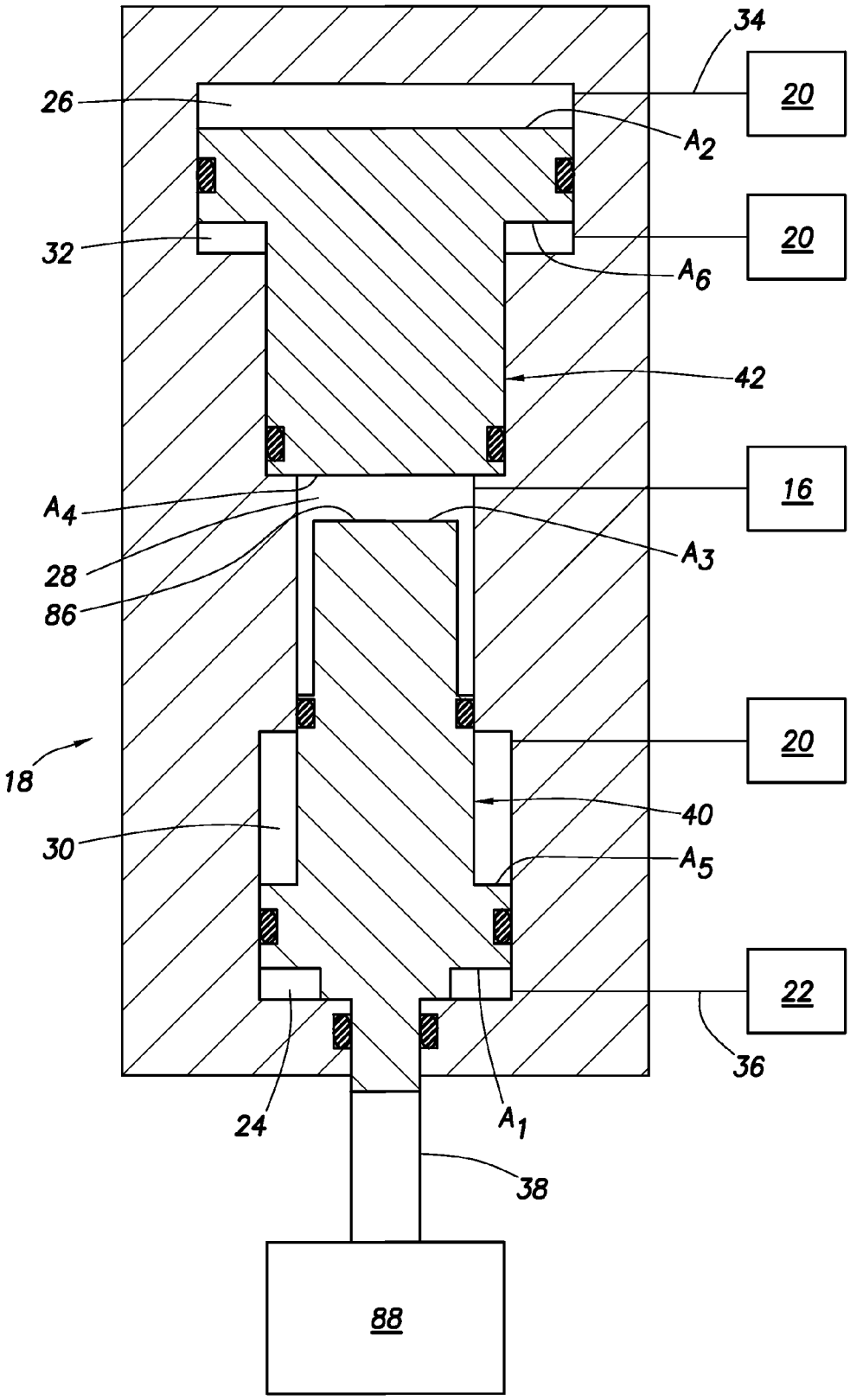
FIG. 4 is a schematic cross-sectional view of another configuration of the actuator.

Referring additionally now to FIG. 4, another configuration of the actuator 18 is representatively illustrated. In this configuration, the operating member 38 is connected at a lower end of the first piston 40, the operating member is displaced to operate another well tool 88, and the pistons 40, 42 are in the form of solid cylindrical elements, instead of annular elements as depicted in FIGS. 3A-C. Otherwise, the operation of the actuator 18 of FIG. 4 is the same as operation of the actuator of FIGS. 3A-C.

The well tool 88 may be any type of well tool, such as a packer, plug, hanger, flow control device, gravel packing tool, running tool, setting tool, etc. The configuration of FIG. 4 demonstrates that various configurations of the actuator 18 are possible, without departing from the principles of this disclosure.

It may now be fully appreciated that the above disclosure provides many advancements to the art of actuating downhole well tools. For example, the actuator 18 can be operated to displace the operating member 38 to more than two positions by manipulating pressure in only two lines 34, 36, with the pressure being supplied from only two pressure sources 20, 22. This aspect of the disclosure is of considerable importance when design space is limited, which is common among downhole tool applications. Of course, other numbers of positions, lines and pressure sources may be utilized, if desired.

The above disclosure describes a method of actuating at least one well tool 44, 46, 88 utilizing first and second pressure sources 20, 22. The method includes the steps of: placing a first chamber 24 of an actuator 18 for the well tool(s) 44, 46, 88 in communication with the first pressure source 20, thereby displacing a first piston 40 from a first position to a second position; and then placing a second chamber 26 of the actuator 18 in communication with the second pressure source 22, thereby displacing the first piston 40 from the second position to a third position.

A second piston 42 may prevent displacement of the first piston 40 to the third position until the second chamber 26 is placed in communication with the second pressure source 22. A third chamber 28 may be at a lower pressure relative to the first pressure source 20 at each of the first, second and third positions of the first piston 40. Each of the first and second pistons 40, 42 may be exposed to the third chamber 28 while the first piston 40 is at each of the first, second and third positions.

The second chamber 26 may be in communication with the first pressure source 20 during the step of placing the first chamber 24 in communication with the first pressure source 20.

The method may also include the steps of operating a first well tool 46 in response to displacing the first piston 40 from the first position to the second position, and operating a second well tool 44 in response to displacing the first piston 40 from the second position to the third position.

Also provided by the above disclosure is a multi-position actuator 18 for actuating at least one well tool 44, 46, 88 utilizing first and second pressure sources 20, 22. The actuator 18 includes first and second chambers 24, 26 in the actuator 18, and an operating member 38 which displaces to operate the well tool(s) 44, 46, 88. A first position of the operating member 38 corresponds to the second pressure source 22 being in communication with the first chamber 24 and the first pressure source 20 being in communication with the second chamber 26. A second position of the operating member 38 corresponds to the first pressure source 20 being in communication with each of the first and second chambers 24, 26. A third position of the operating member 38 corresponds to the first pressure source 20 being in communication with the first chamber 24 and the second pressure source 22 being in communication with the second chamber 26.

The first pressure source 20 may supply a higher pressure than the second pressure source 22.

The actuator 18 may also include first and second pistons 40, 42. The first piston 40 may be exposed to the first chamber 24, and the second piston 42 may be exposed to the second chamber 26.

The actuator 18 may include a third chamber 28 at a lower pressure relative to the first pressure source 20 at each of the first, second and third positions of the operating member 38. The first and second pistons 40, 42 may be exposed to the third chamber 28 at each of the first, second and third positions of the operating member 38.

The actuator 18 may also include fourth and fifth chambers 30, 32 in communication with the first pressure source 20 at each of the first, second and third positions of the operating member 38. The first piston 40 may be exposed to the fourth chamber 30 at each of the first, second and third positions of the operating member 38, and the second piston 42 may be exposed to the fifth chamber 32 at each of the first, second and third positions of the operating member 38.

Also provided by the above disclosure is a multi-position actuator 18 for actuating at least one well tool 44, 46, 88 utilizing first and second pressure sources 20, 22, with the actuator 18 including first and second chambers 24, 26 in the actuator 18, and a first piston 40 which displaces an operating member 38 to operate the well tool(s) 44, 46, 88. The first piston 40 has a first position in the actuator 18 corresponding to the second pressure source 22 being in communication with the first chamber 24 and the first pressure source 20 being in communication with the second chamber 26. The first piston 40 has a second position in the actuator 18 corresponding to the first pressure source 20 being in communication with each of the first and second chambers 24, 26. The first piston 40 has a third position in the actuator 18 corresponding to the first pressure source 20 being in communication with the first chamber 24 and the second pressure source 22 being in communication with the second chamber 26.

The second position may be located between the first and third positions.

The first piston 40 may have a first surface area A1 exposed to the first chamber 24. The actuator 18 may include a second piston 42 having a second surface area A2 exposed to the second chamber 26. The second surface area A2 may be greater than the first surface area A1.

The first piston 40 may be biased into contact with the second piston 42, thereby preventing displacement of the first piston 40 to the third position, when the first piston 40 is in the second position.

The first and second pistons 40, 42 may be exposed to the second pressure source 22 at each of the first, second and third positions of the first piston 40.

The first piston 40 may have a third surface area A3 exposed to a low pressure relative to the first pressure source 20. The second piston 42 may have a fourth surface area A4 exposed to the low pressure relative to the first pressure source 20. The fourth surface area A4 may be greater than the third surface area A3.

The first piston 40 may have a fifth surface area A5 exposed to the first pressure source 20, and the second piston 42 may have a sixth surface area A6 exposed to the first pressure source 20. A difference between the first and fifth surface areas A1, A5 on the first piston 40 may be less than a difference between the second and sixth surface areas A2, A6 on the second piston 42.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. For example, although the actuator 18 may be described above as a hydraulic actuator, it could operate with other fluids (including gases), it could be a pneumatic actuator, etc. Accordingly, the foregoing detailed description is to be clearly understood as being given by way of illustration and example only, the spirit and scope of the present invention being limited solely by the appended claims and their equivalents.

What is claimed is:

1. A method of actuating at least one well tool utilizing first and second pressure sources, the method comprising the steps of:

placing a first chamber of an actuator for the well tool in communication with the first pressure source, thereby displacing a first piston from a first position to a second position;

then placing a second chamber of the actuator in communication with the second pressure source, thereby displacing the first piston from the second position to a third position;

operating a first well tool in response to displacing the first piston from the first position to the second position; and operating a second well tool in response to displacing the first piston from the second position to the third position.

2. The method of claim 1, wherein a second piston prevents displacement of the first piston to the third position until the second chamber is placed in communication with the second pressure source.

3. The method of claim 2, wherein a third chamber is at a lower pressure relative to the first pressure source at each of the first, second and third positions of the first piston, and wherein each of the first and second pistons is exposed to the third chamber while the first piston is at each of the first, second and third positions.

4. The method of claim 1, wherein the second chamber is in communication with the first pressure source during the step of placing the first chamber in communication with the first pressure source.

5. A multi-position actuator for actuating at least one well tool utilizing first and second pressure sources, the actuator comprising:

first, second, and third chambers in the actuator; and an operating member which displaces to operate the well tool, a first position of the operating member corresponding to the second pressure source being in communication with the first chamber and the first pressure source being in communication with the second and third chambers, a second position of the operating member corresponding to the first pressure source being in communication with each of the first, second, and third chambers, and a third position of the operating member corresponding to the first pressure source being in communication with the first and third chambers and the second pressure source being in communication with the second chamber.

6. The actuator of claim 5, wherein the first pressure source supplies a higher pressure than the second pressure source.

7. The actuator of claim 5, further comprising first and second pistons, and wherein the first piston is exposed to the first chamber, and the second piston is exposed to the second chamber.

8. The actuator of claim 7, further comprising a fourth chamber at a lower pressure relative to the first pressure source at each of the first, second and third positions of the operating member, and wherein the first and second pistons are exposed to the fourth chamber at each of the first, second and third positions of the operating member.

9. The actuator of claim 7, further comprising a fifth chamber in communication with the first pressure source at each of the first, second and third positions of the operating member, and wherein the second piston is exposed to the fifth chamber at each of the first, second and third positions of the operating member.

10. A multi-position actuator for actuating at least one well tool utilizing first and second pressure sources, the actuator comprising:

first and second chambers in the actuator; and a first piston which displaces to operate the well tool, the first piston having a first position in the actuator corresponding to the second pressure source being in communication with the first chamber and the first pressure source being in communication with the second chamber, the first piston having a second position in the actuator corresponding to the first pressure source being in communication with each of the first and second chambers and wherein displacement of the first piston is limited by a second piston, and the first piston having a third position in the actuator corresponding to the first pressure source being in communication with the first chamber and the second pressure source being in communication with the second chamber, wherein the first piston has a first surface area exposed to the first chamber, and wherein the second piston has a second surface area exposed to the second chamber, and wherein the first and second pistons are exposed to the second pressure source at each of the first, second and third positions of the first piston.

11. The actuator of claim 10, wherein the second position is located between the first and third positions.

12. The actuator of claim 10, wherein the second surface area is greater than the first surface area.

13. The actuator of claim 10, wherein the first piston is biased into contact with the second piston, thereby preventing displacement of the first piston to the third position, when the first piston is in the second position.

14. The actuator of claim 10, wherein the first piston has a third surface area exposed to a lower pressure relative to the first pressure source, and the second piston has a fourth surface area exposed to the lower pressure relative to the first pressure source.

15. The actuator of claim 14, wherein the fourth surface area is greater than the third surface area.

16. The actuator of claim 14, wherein the first piston has a fifth surface area exposed to the first pressure source, and the second piston has a sixth surface area exposed to the first pressure source.

17. The actuator of claim 16, wherein a difference between the first and fifth surface areas on the first piston is less than a difference between the second and sixth surface areas on the second piston.

* * * * *